US012644677B2

(12) United States Patent
Tamao

(10) Patent No.: US 12,644,677 B2
(45) Date of Patent: Jun. 2, 2026

(54) FOLDING TARGET STAND

(71) Applicant: Walter Toshio Tamao, Wailuku, HI (US)

(72) Inventor: Walter Toshio Tamao, Wailuku, HI (US)

( * ) Notice: Subject to any disclaimer, the term of this patent is extended or adjusted under 35 U.S.C. 154(b) by 327 days.

(21) Appl. No.: 18/611,739

(22) Filed: Mar. 21, 2024

(65) Prior Publication Data

US 2024/0361105 A1 Oct. 31, 2024

Related U.S. Application Data

(60) Provisional application No. 63/499,200, filed on Apr. 28, 2023.

(51) Int. Cl.
*F41J 1/10* (2006.01)

(52) U.S. Cl.
CPC ..... *F41J 1/10* (2013.01)

(58) Field of Classification Search
CPC ..... F41J 1/10
See application file for complete search history.

(56) References Cited

U.S. PATENT DOCUMENTS 2,335,393 A * 11/1943 De Lubicz-Bakanowski ..... F41J 1/10 463/49
5,947,477 A * 9/1999 Turnipseed ..... F41J 1/10 273/359
5,967,523 A * 10/1999 Brownlee ..... F41J 1/10 273/407
8,505,921 B2 * 8/2013 Amodt ..... F41J 1/10 273/407
9,528,798 B1 * 12/2016 Hodge, Jr. ..... F41J 1/10
11,561,072 B1 * 1/2023 Larsen ..... G09F 15/0068

* cited by examiner

*Primary Examiner* — Audrey B. Walter

(57) ABSTRACT

Folding Target Stand 10 consists of a rectangular base having a middle cross member to which a vertical stand assembly is bolted in place. The stand assembly is composed of two sections of PVC pipes connected by a PVC cross piece on the lower part of the stand assembly via PVC tee connectors. The short PVC pipe sections on either side of the stand assembly are fitted internally with threaded rod assemblies which are used to secure the stand assembly to the base. Diagonal support pieces provide additional stability to the stand assembly. Slotted arms allow for a corrugated plastic target plate to be adjusted for height. The target plate and stand assembly can be folded down onto the base so that the target stand can be either transported or stored as one piece.

3 Claims, 5 Drawing Sheets

FIG. 4
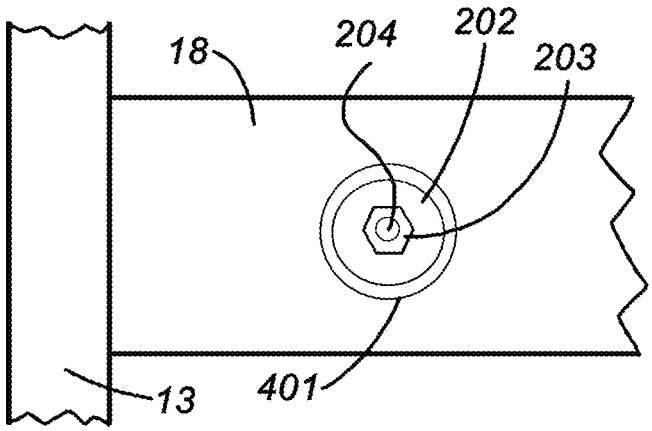
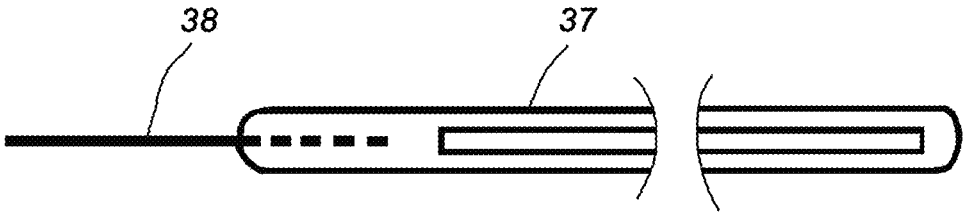
FIG. 5

FOLDING TARGET STAND

CROSS-REFERENCE TO RELATED APPLICATIONS

This application claims the benefits derived from U.S. Provisional Application No. 63/499,200 filed on Apr. 28, 2023.

PRIOR ART

There are numerous examples of the prior art of securing a target to a stand, with or without a base of some kind, whether for use in archery, dart throwing, pistol shooting or riflery. Reference is made to the prior art listed in US20120313324 A1. However, the following US Patents appear to be the most relevant to the present invention: U.S. Pat. Nos. 5,503,356; 5,967,523; 20090315265A1; 20110175294A1; 8,695,985B2; 20160298942A1, 11,561,072B1, 0631175A and 0271647A. Of the foreign patents, the following appear to be the most relevant: GB560067A; GB2079164A and KR101610221B1.

BACKGROUND OF THE INVENTION

With increased urbanization it is becoming more difficult to find a suitable place to practice marksmanship with either a handgun or rifle in accordance with all applicable state, county and city laws. Many private indoor ranges offer a venue for pistol shooting, but preclude most rifles due to distance limitations or caliber restrictions. That leaves us with outdoor ranges owned or managed by private or government entities.

Although some venues offer target stands and bases as part of a range fee, these are often heavy and unwieldy and may require the use of iron stakes to secure the target base to the ground. Without a shooting partner, all of this equipment, together with a 4-pound hammer, need to be carried downrange solo for set up. Stress levels increase in direct proportion to the distance that the equipment needs to be carried for set-up, and brought back after the range session.

This is the fertile ground from which a desire for a portable, lightweight, durable, stable and height-adjustable target stand is born. The design of the target stand must also account for the varied wind and soil conditions found at the range.

SUMMARY OF THE INVENTION

The present invention addresses all of the desired features of a target stand by incorporating design features which will make this possible.

The folding target stand has a rectangular base that is composed of lightweight wood and is proportioned to provide a wide enough footprint to insure stability against moderate wind conditions without the use of stakes.

The rectangular base has a middle cross-member on which a stand assembly is bolted into place by means of threaded rod assemblies inserted into each of the short pipe sections of the stand assembly.

The threaded rod assemblies have exposed portion of the threaded rods and these are inserted into two drilled holes, one on either end of the rectangular base cross-member. Each drilled hole is protected by a metal sleeve to prevent wear of the wooden base. The threaded rods are secured in place with hex nuts.

The stability of the stand assembly is reinforced by two diagonal support pieces which connect on either sides of the stand assembly and to the pivot anchors located on the rectangular base. Although the stand assembly is very stable when bolted to the middle cross-member of the base, the diagonal support pieces provide additional stability.

Above the area where the diagonal supports connect to the target stand there are also slotted arms for which one end is bolted to the target stand and the other end having a steel rod is inserted into a corrugated plastic target plate. The corrugated plastic target plate can thus be adjusted up and down by loosening the bolts on the stand and moving the slotted arms to the desired height.

Loosening the bolts holding the slotted arms will enable the slotted arms and target plate to fold down onto the stand assembly, and the stand assembly itself can be lifted up and folded onto the base after removing the hexagonal nuts securing the stand assembly. Thus, the folded target stand can be transported as one piece with no disassembly of any of the parts except for the two hexagonal nuts, which can be screwed back onto the threaded rods after the range session.

After the initial set-up of the folding target stand downrange, the target stand can be moved to another location by loosening the bolts of the slotted arms using a nut driver and folding the arms and target plate down on the stand assembly. Velcro pieces on the back of the corrugated plastic target plate and on the cross piece of the stand can secure the target plate from movement. The base, near the middle cross-member, can be grasped with one hand, and the target stand can be carried to the new location, taking care that the target plate is not dragged on the ground.

The fully assembled target stand is light enough that the whole stand can be lifted up over the head by grasping the long sections of the base and carried to the new location. However, this is not recommended since one can lose one's balance on the range, and dropping the stand can result in bodily injury and damage to critical parts of the stand.

BRIEF DESCRIPTION OF DRAWINGS

FIG. 4 is a schematic elevational view showing the bottom of the rectangular base where a large drilled hole in the base accommodates the metal washer, hexagonal nut and threaded rod of the threaded rod assembly.

FIG. 5 is a schematic elevational view of one of the two slotted arms, showing how it can be used to adjust the height of the corrugated plastic target plate.

DETAILED DESCRIPTION OF THE INVENTION

Figure 1:
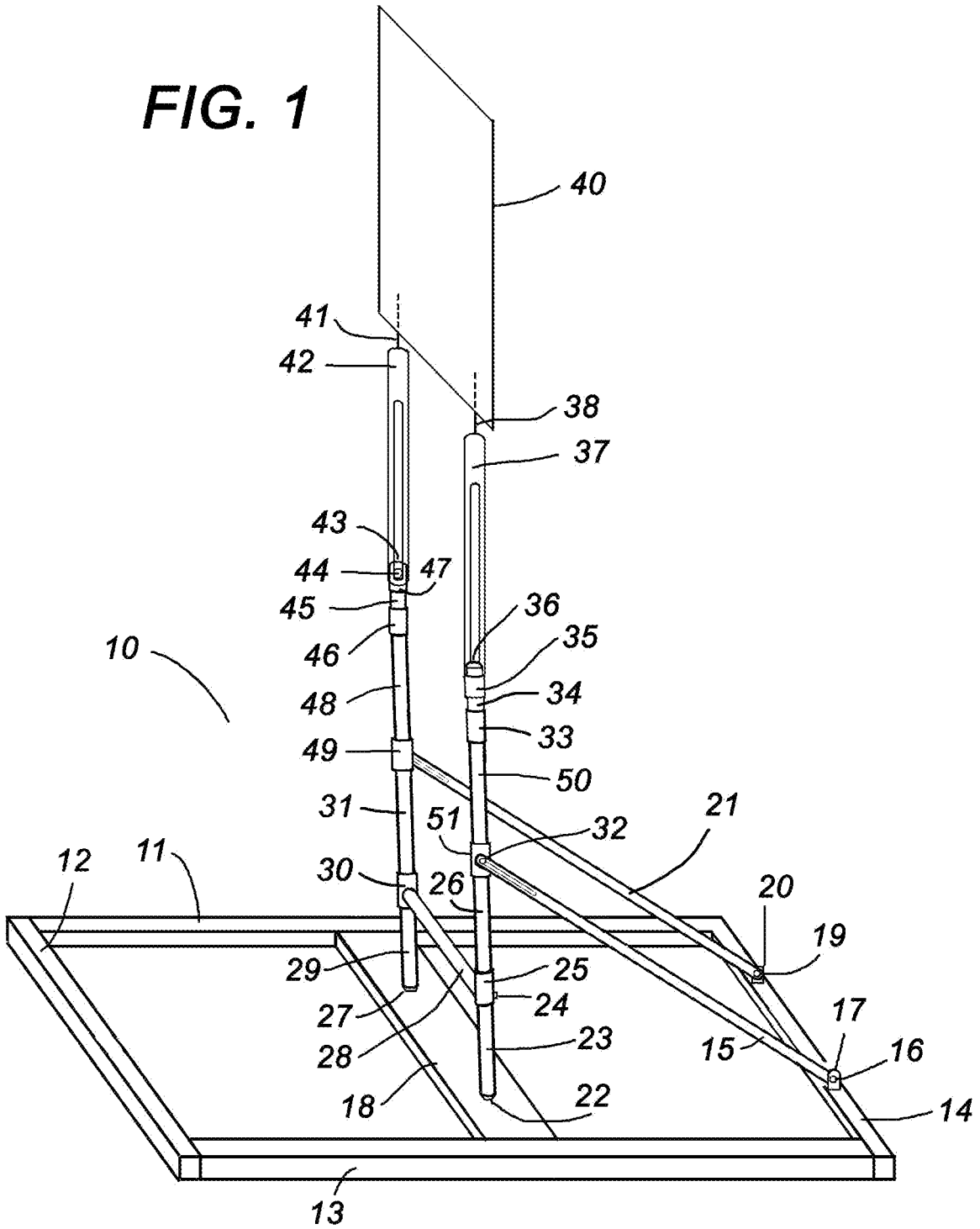
FIG. 1 is a schematic perspective view of the present invention showing the rectangular base, stand assembly, diagonal support pieces, slotted arm pieces and the corrugated plastic target plate, all in its fully assembled, unfolded configuration. The longer PVC pipe segments have been shortened to better fit the drawing to the page.

FIG. 1 shows a schematic perspective view of the folding target stand 10 having a rectangular base consisting of short segments 12 and 14 and long segments 11 and 13. There is a middle cross-member 18 which is wider than the other segments, but of equal thickness.

In this embodiment of the present invention, the rectangular base segments are composed of 2×2-inch lightweight wood such as pine and the wider middle cross-member is a 2×4-inch piece of pinewood. However, this is not to preclude the use of other materials or to restrict dimensional aspects such as thickness, or to use material that is hollow or solid when constructing the rectangular base.

The short segments 12 and 14 are attached to the long segments 11 and 13 using wood screws of appropriate size. The middle cross member 18 is secured using corner braces and screws at the four intersections with the long segments 11 and 13.

The rectangular base is about 25.5 inches wide and 39 inches long. Experience on the range suggests that these dimensions provide a wide enough footprint to insure stability against moderate wind conditions without the use of stakes to secure the base to the ground.

Figure 2:
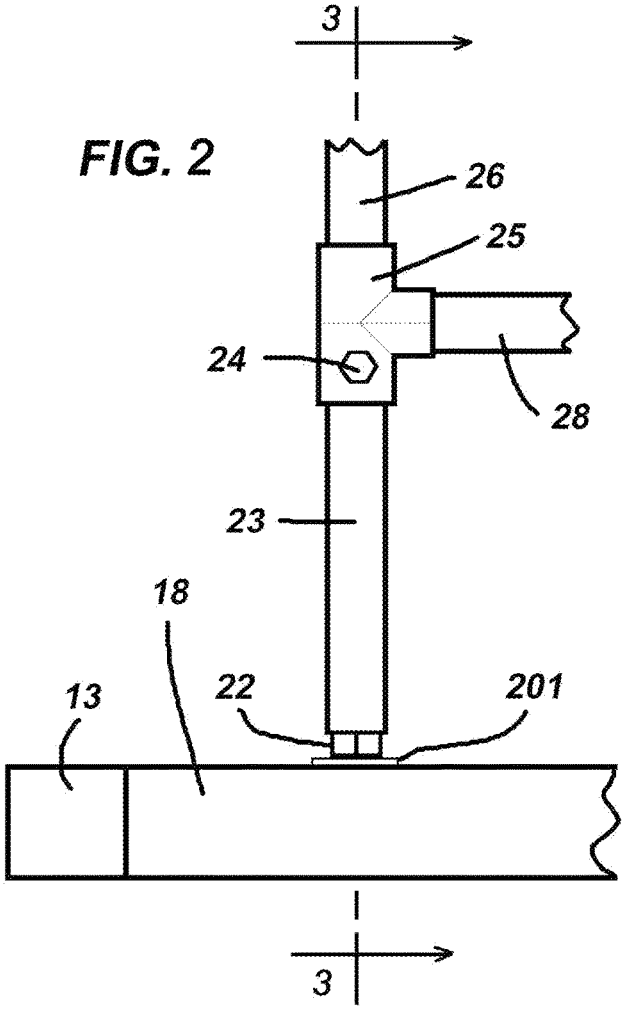
FIG. 2 is a schematic elevational view of one side of the stand assembly where a PVC tee connector connects the long, short and cross piece PVC pipes. Also shown is the rectangular base as it connects to the stand assembly.
Figure 3:
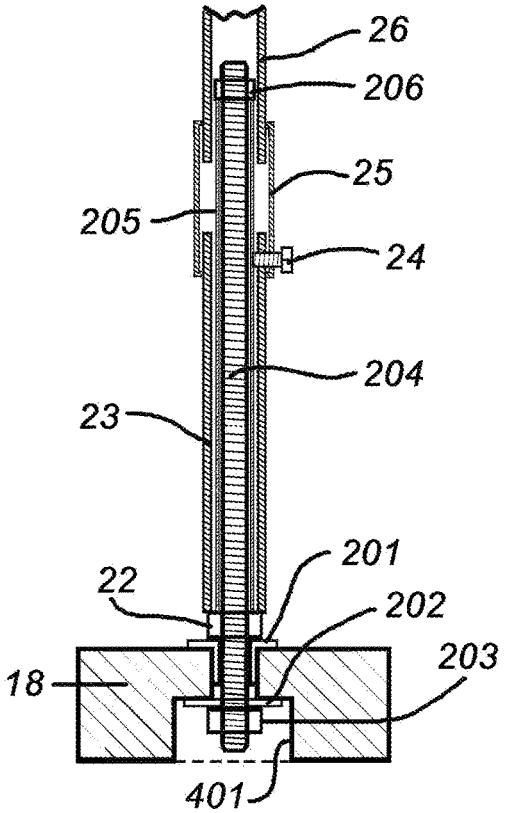
FIG. 3 is a schematic sectional view taken from line 3-3 of FIG. 2 showing one of the two threaded rod assemblies used to bolt the stand assembly to the base. It also shows how the retaining bolt holds the threaded rod assembly securely within the stand assembly.

The middle cross-member 18 of the base has two drilled holes where hexagonal nuts 22 and 27 are located, as shown in FIG. 1. Each drilled hole is protected by a metal sleeve 201 on one end and an identical metal sleeve on the other end of middle cross member 18 as shown in FIG. 2 and FIG. 3 to prevent wear.

All PVC pipe sections, couplings, tees and caps used in the present embodiment of this invention are Schedule 40 PVC pipes and fittings and ½-inch in size.

As shown in FIG. 1, the stand assembly consists of PVC pipe 26 and PVC pipe 31 with each pipe fitted with tee connectors 25 and 30 respectively. The other end of PVC pipe 26 is connected to coupling piece 51 and the other end of PVC pipe 31 is connected to coupling piece 49.

PVC pipe 50 is connected to coupling piece 51 on one end and to coupling pieces 33 and 35 on the other end. Similarly, PVC pipe 48 is connected to coupling piece 49 on one end and to coupling pieces 46 and 47 on the other end.

Figure 6:
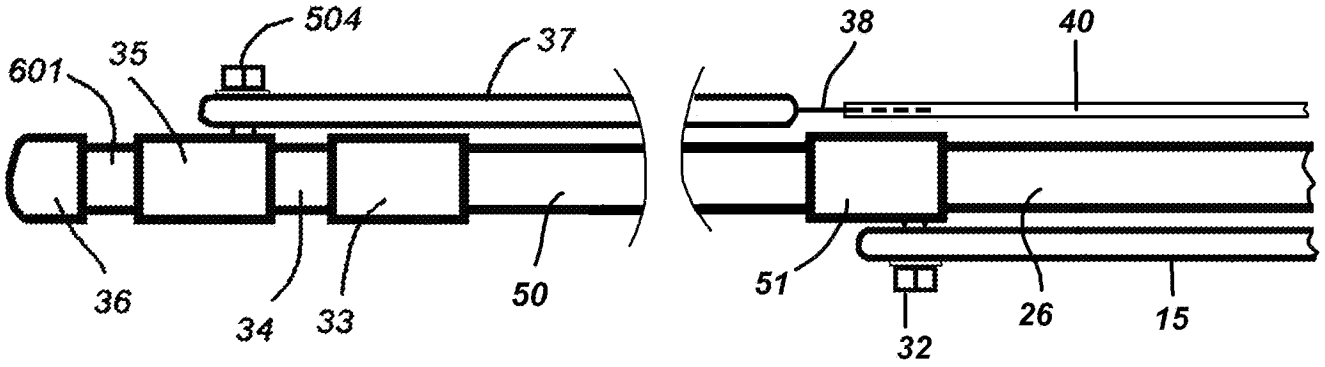
FIG. 6 is a schematic elevational view of one of the two pipe sections of the stand assembly showing how the slotted arm and diagonal support pieces connect with the coupling pieces of the pipe sections.

PVC nipple 34 connects coupling piece 33 to coupling piece 35. Similarly, PVC nipple 45 connects coupling piece 46 to coupling piece 47. As shown in FIG. 6, PVC nipple 601 connects coupling piece 35 to cap 36. A PVC nipple identical to PVC nipple 601 connects coupling piece 47 to cap 43.

PVC cross piece 28 is inserted into the middle ports of the tee connectors 25 and 30 so that the cross piece is perpendicular to PVC pipes 26 and 31. Short pipe 23 and short pipe 29 are inserted into each of the tee connectors so that the short pipes are in-line with the longer pipe sections.

All PVC pipe sections, tee connections, couplings and nipples are glued together with the exception of the caps which are friction-fitted on the nipples. However, in the event of damage caused by bullet strikes, it may not be possible to effect simple repairs depending on the location and extent of the damage.

An alternative method of securing the pipe sections onto the coupling pieces and tee connectors is to use ¼-inch bolts threaded into drilled and tapped holes at the appropriate locations of the joined pieces. The use of bolts will enable easy replacement of any pipe sections or fittings should they become damaged.

The use of threaded rod assemblies is a novel way to secure a vertical target stand to a horizontal base. Their manner of construction is described in the following narrative.

Referring to FIG. 3, the threaded rod assembly consists of threaded rod 204 which is a ⅜-inch steel rod with 16 pitch threading and 9-inch length. Threaded rod 204 is inserted into brass sleeve 205 which is about 6 inches long.

Brass sleeve 205 is held in place by round nut 206 on one end of threaded rod 204 and a hexagonal nut 22 on the other end in such a way that there will be about 1 inch of exposed threading past round nut 206 and about 1.5 inches of exposed threading past hexagonal nut 22.

Once the nuts have been adequately tightened against brass sleeve 205, the threaded rod assembly is complete. It can then be inserted into short pipe 23 of the stand assembly.

The round nut 206 is large enough to hold brass sleeve 205 but small enough to be inserted into the short pipe 23 together with the brass sleeve 205 and threaded rod 204. Since hexagonal nut 22 is larger than the inside diameter of the short pipe 23, it will prevent further insertion into the pipe.

While keeping hexagonal nut 22 butted against the end of short pipe 23, retaining hex bolt 24, located on the lower part of tee connector 25, is tightened to about 20 inch-pounds of torque which essentially crushes brass sleeve 205 against threaded rod 204 and thereby secures the threaded rod assembly firmly inside short pipe 23.

The retaining hex bolt 24 is an 8 mm metric bolt with 1.25 pitch and 15 mm of thread length. It is threaded into place via a drilled hole with matching internal threads on the lower section of tee connector 25 as shown in FIG. 3.

Since the internal threads for holding retaining hex bolt 24 is tapped into PVC material, a torque not exceeding 20 inch-pounds is recommended. Over-torquing may result in damage to the internal threads.

Figure 7:
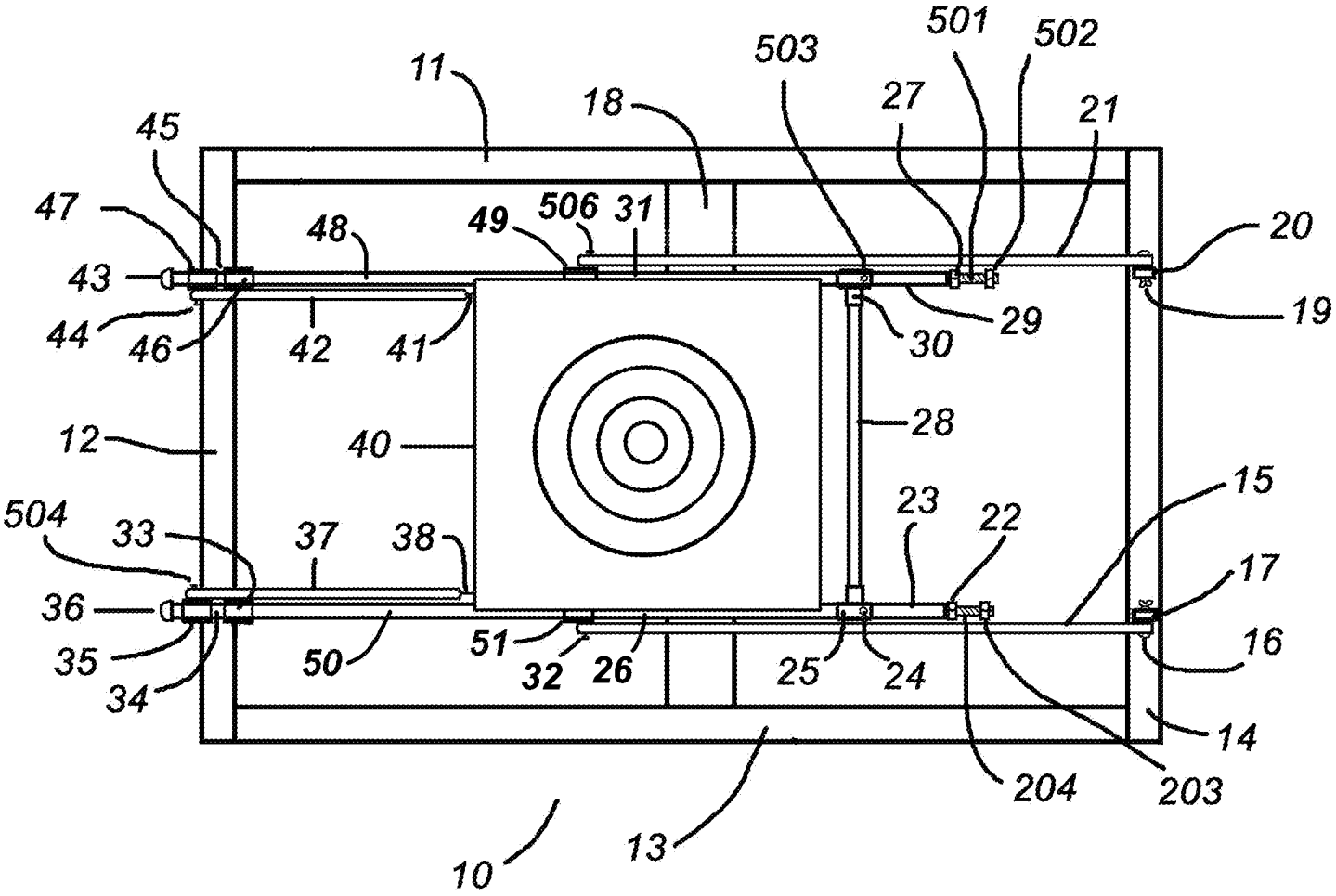
FIG. 7 is a schematic elevational view of the folding target stand in its folded configuration. The corrugated plastic target plate has been moved and also shortened to show the PVC pipe cross piece of the stand assembly.

A threaded rod assembly identical to the one described above is inserted in short pipe 29 and secured in place with a retaining hex bolt 503 (see FIG. 7) located on the lower part of tee connection 30 and threaded in place via a drilled hole having matching internal threads. At this point, a complete stand assembly has been described.

The 1.5-inch lengths of the exposed threaded rods of the stand assembly are inserted into metal-sleeved drilled holes located on the middle cross-member 18 of the rectangular base. On one side of the stand assembly, hex nut 22 rests on top of metal sleeve 201.

Threaded rod 204 is fitted with large washer 202 and hex nut 203 as shown in FIG. 3, and FIG. 4. Hexagonal nut 203 is then finger-tightened to secure that part of the stand assembly. The large drilled hole 401 as shown in FIG. 3 and FIG. 4 accommodates large washer 202, hexagonal nut 203 and threaded rod 204.

For that part of the stand assembly where a threaded rod assembly is housed in short pipe 29, hex nut 27 rests on top of a metal sleeve, identical to metal sleeve 201. Also, the threaded rod 501 (see FIG. 7) is fitted with a large washer and hex nut 502 that is finger-tightened to secure that part of the stand assembly. A large drilled hole identical to large drilled hole 401 houses the portion of the threaded rod that is fitted with a large washer and a hex nut.

The stand assembly is reinforced by two diagonal support pieces 15 and 21 which connect on either side of the stand assembly and specifically on the lower parts of PVC coupling pieces 51 and 49. As shown in FIG. 6, diagonal support piece 15 is loosely bolted onto PVC coupling piece 51 using an 8 mm×1.25×25 mm bolt 32 via a threaded drilled hole in coupling piece 51. Diagonal support piece 21 is similarly connected to coupling piece 49 on the other side of the stand assembly using hex bolt 506 (see FIG. 7).

Diagonal support pieces 15 and 21 each have 6-inch slotted sections to allow hex bolts 32 and 506 to connect the diagonal support pieces to PVC coupling pieces 51 and 49 respectively. The slotted sections also allow each diagonal support piece some degree of leeway during folding and unfolding of the stand assembly.

Diagonal support pieces 15 and 21 are connected to pivot anchors 17 and 20 respectively. As shown in FIG. 1, the pivot anchors 17 and 20 are located on the short segment 14 of the rectangular base and secured using wood screws of appropriate size.

Machine bolts 16 and 19 fitted with wing nuts loosely connect diagonal support pieces 15 and 21 to the pivot anchors 17 and 20 to allow for rotational movement of the diagonal support pieces during the folding and unfolding of the stand assembly.

Although the stand assembly is very stable when bolted to the middle cross-member 18 of the rectangular base, it is envisoned that the nuts securing the stand assembly be finger-tightened only to eliminate the need for additional tools for set up. The diagonal support pieces will provide additional stability.

Referring to FIG. 1, above the area where the diagonal supports connect to the target stand, there are also slotted arms 37 and 42. As shown in FIG. 5, slotted arm 37 is about 15 inches long with rounded ends. The slot which measures 12 inches long, begins at about one inch from one end of slotted arm 37 and 2 inches short of reaching the opposite end.

The end having 2 inches of unslotted area has a drilled hole about 1.75 inches deep into which steel rod 38 is inserted and glued in place. The other exposed section of steel rod 38 is about 7 inches long. Slotted arm 42 is identical to slotted arm 37 and equipped with steel rod 41.

As shown in FIG. 6, slotted arm 37 connects to the stand assembly at the bottom portion of coupling piece 35 via the 8 mm×1.25 hex bolt 504 which has 25 mm of thread length. Hex bolt 504 is threaded into a drilled and appropriately tapped hole in coupling piece 35.

Slotted arm 42 connects to coupling piece 47 of the stand assembly and is secured with hex bolt 44 which is threaded into an appropriately sized drilled and tapped hole located on the lower part of coupling piece 47.

The steel rods 38 and 41, of slotted arms 37 and 42 respectively, are inserted into corrugated plastic target plate 40 via the square channels which comprises the corrugated plastic plate and which runs down the length of the plate.

When the stand assembly is in its vertical position, loosening hex bolts 44 and 504 will allow slotted arms 37 and 42 to be moved up or down to adjust corrugated plastic target plate 40 to the desired height. At this point, folding target stand 10 has been described.

On a fully assembled target stand, the procedure for folding the target begins with loosening hex bolts 44 and 504 holding slotted arms 37 and 42 using a socket driver.

The arms and the corrugated plastic target plate 40 can then be rotated in the direction where the diagonal support pivot anchors 17 and 20 are located and allowed to contact PVC cross piece 28 of the stand assembly.

Velcro pieces on the back of corrugated plastic target plate 40 and on PVC cross piece 28 can immobilize the target plate.

The rectangular base can then be tilted up from one end of middle cross member 18 to gain access to hex nut 203 and its counterpart hex nut 502 on the other end of middle cross member 18. The two nuts can be removed and set aside.

Again, from the direction of the diagonal support pivot anchors 17 and 20, short pipes 23 and 29 of the stand assembly can be grasped using both hands and lifted up so that the threaded rods 204 and 501 clear the top of middle piece 18 of the base.

While still holding on to short pipes 23 and 29, the stand assembly can then be slowly rotated in the direction of the of the diagonal support pivot anchors, and as the stand is slowly lowered, diagonal support pieces 15 and 21 can also be grasped to finally bring the stand assembly to its folded, resting position.

Velcro strips can be used to secure the stand assembly to the rectangular base. Threading nuts 203 and 502 back onto the threaded rods completes the folding process.

What is claimed is:

1. A folding target stand comprising:

a rectangular base having a plurality of frame members and a middle cross member;

a stand assembly consisting of two PVC pipe sections which is bolted onto the middle cross member of the base via two drilled holes fitted with metal sleeves on the middle cross member wherein:

each PVC pipe section consists of a long pipe, fitted on one end with two PVC coupling pieces and a cap all joined together with pipe nipples, and fitted on the other end with a PVC coupling which connects to another long PVC pipe which in turn connects to a PVC tee connector;

the two PVC pipe sections are joined to each other via a PVC pipe cross piece which is inserted into the middle port of the tee connectors;

each PVC pipe section has a short pipe inserted into the remaining port of the tee connectors where each short pipe has inserted within, threaded rod assemblies consisting of a steel threaded rod fitted with a brass sleeve held in place by a round plastic nut on one end and a steel hexagonal nut on the other, whereby:

the end where the threaded rod assembly is fitted with the round plastic nut is inserted into the short PVC pipe up to the point of the steel hexagonal nut;

the threaded rod assembly is secured within the PVC short pipe by means of a retaining bolt, threaded into a drilled and tapped hole on the lower part of the tee connector;

each of the threaded rod assemblies has a section of threaded rod past the steel hexagonal nut which is inserted into the metal-sleeved holes of the middle cross member of the base, and hexagonal nuts are used to secure the threaded rod assemblies and thereby the stand assembly to the rectangular base.

2. A folding target stand as claimed in claim 1, further comprising a pair of diagonal support pieces which are connected to either side of the stand assembly, at a point where the PVC coupling pieces which join the two long PVC pipe sections are located, via a hex bolt threaded into a drilled and tapped hole on the PVC coupling pieces, whereby:

each of the diagonal support pieces are slotted at the hex bolt section to allow for vertical movements of the stand assembly during folding and unfolding procedures of the stand assembly, and each of the diagonal support pieces are connected to pivot anchors located on one of the short segments of the rectangular base and fitted with machine bolts and wing nuts, to allow for rotation of the diagonal support pieces during the folding and unfolding procedures of the stand assembly.

3. A folding target stand as claimed in claim 1, further comprising of a pair of slotted arms which are attached to the stand assembly at the PVC coupling pieces above those which connects the diagonal support pieces, using hex bolts threaded into drilled and tapped holes in the PVC coupling pieces whereby:

each slotted arm is fitted with a steel rod via a drilled hole and secured with glue, and the other end of the steel rod is inserted into a corrugated plastic target plate, and each slotted arm can be moved up or down, thereby moving the corrugated plastic target plate up or down, by sufficiently loosening the hex bolt securing the slotted arms to the stand assembly.

* * * * *